United States Patent [19]

Wagner

[11] 4,049,520

[45] Sept. 20, 1977

[54] COLOR IMPROVEMENT PROCESS FOR ORGANIC LIQUID

[75] Inventor: Oliver Wagner, Houston, Tex.

[73] Assignee: Petrolite Corporation, St. Louis, Mo.

[21] Appl. No.: 668,561

[22] Filed: Mar. 19, 1976

[51] Int. Cl.[2] ..... B03C 5/00

[52] U.S. Cl. ..... 204/186; 204/131

[58] Field of Search ..... 204/186, 180 R, 131

[56] References Cited

U.S. PATENT DOCUMENTS

| | | | |
|---|---|---|---|
| 1,162,213 | 11/1915 | Bloom | 204/186 |
| 1,377,021 | 5/1921 | Mumford | 204/186 |
| 2,516,733 | 7/1950 | Unschuld | 204/186 |
| 3,394,067 | 7/1968 | Shirley | 204/186 |
| 3,709,802 | 1/1973 | Okuhara et al. | 204/180 R |
| 3,799,855 | 3/1974 | Franse | 204/188 |

FOREIGN PATENT DOCUMENTS

| | | | |
|---|---|---|---|
| 494,153 | 10/1938 | United Kingdom | 204/186 |

OTHER PUBLICATIONS

Soybean Chemistry and Technology, Klare Markley, et al., 1944, pp. 232–240.

*Primary Examiner*—T. M. Tufariello

*Attorney, Agent, or Firm*—Sidney B. Ring; Hyman F. Glass

[57] ABSTRACT

A process for the color improvement of a non-petroleum organic liquid (fats, animal and vegetable oils) containing color impurities (e.g. chlorophyll). The organic liquid is subjected in succession to a refining step using an aqueous reagent, a hydrogenation step wherein the organic liquid in the presence of a finely divided catalyst at elevated temperatures is hydrogenated. The organic liquid carrying entrained catalyst is mixed with a finely dispersed solid adsorbent adapted to remove color bodies. Electrofiltration of the mixture of organic liquid, catalyst and solid adsorbent after hydrogenation effects substantially complete removal of the catalyst and solid adsorbent from the organic liquid thereby providing a solids-free, color improved organic liquid which is passed to a subsequent utilization. Adsorbent mixing and electrofiltration steps are conducted in an atmosphere substantially devoid of oxygen-containing gases.

27 Claims, 1 Drawing Figure

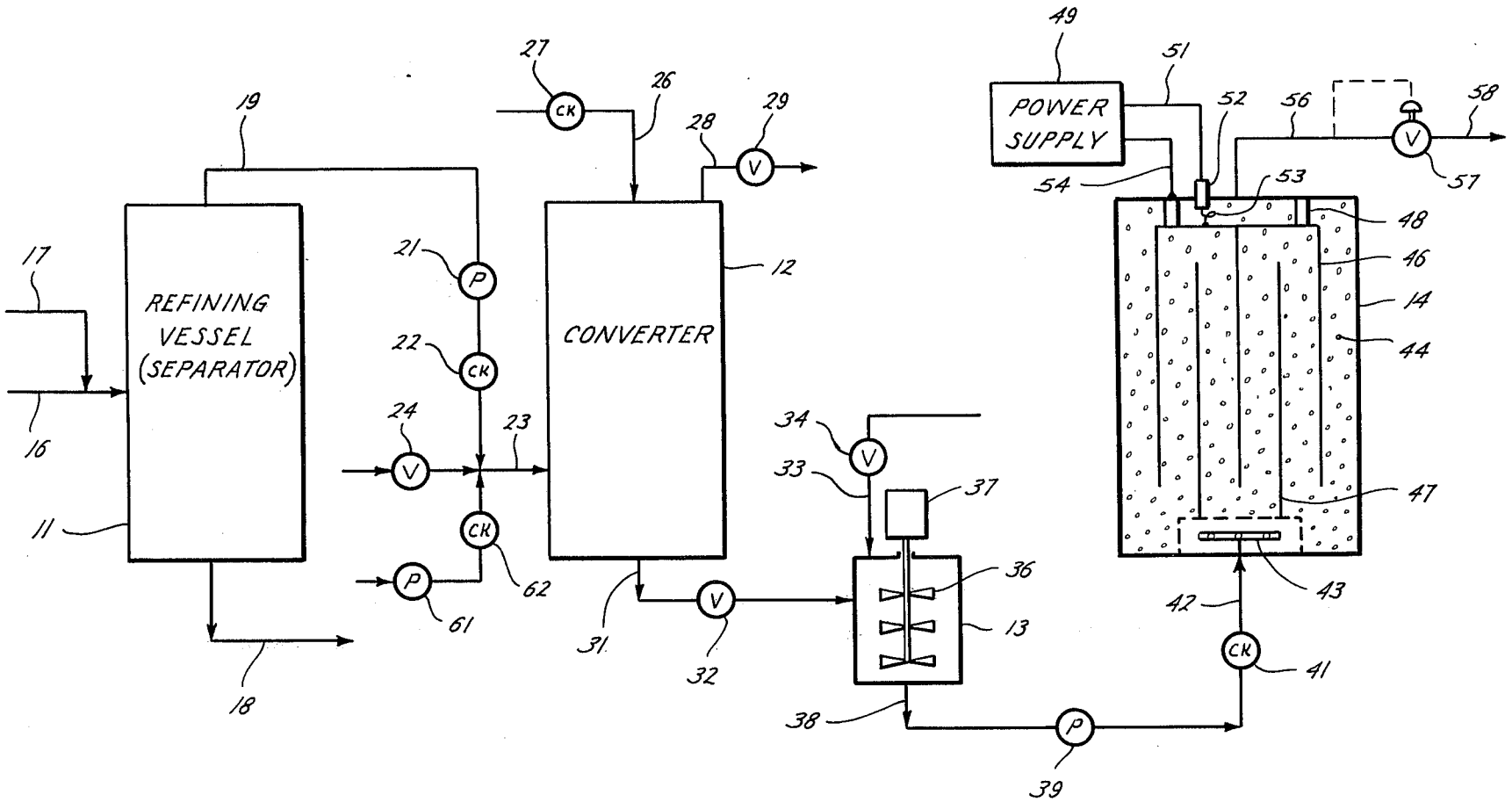
REFINING VESSEL (SEPARATOR)
CONVERTER
POWER SUPPLY
11
12
13
14
16
17
18
19
21
22
23
24
26
27
28
29
31
32
33
34
36
37
38
39
41
42
43
44
46
47
48
49
51
52
53
54
56
57
58
61
62

COLOR IMPROVEMENT PROCESS FOR ORGANIC LIQUID

BACKGROUND OF THE INVENTION

1. Field of the Invention

This invention relates to the processing of a non-petroleum organic liquid such as fats, animal and vegetable oils; and more particularly to the improvement in color of such an organic liquid by a multistep treating process.

2. Description of the Prior Art

Many non-petroleum organic liquids (e.g., fats, vegetable and animal oils) are used for human consumption and other utilizations. The organic liquid can be purified chemically and mechanically to remove solids and to improve chemical properties, color, odor and enhance storage stability, to make it more suitable for ultimate utilization. Present day treatment of crude fat, animal and vegetable oils, as organic liquids, consist generally of the steps of refining, bleaching, and deodorization. The term "refining" refers to any purification treatment designed to remove undesired materials such as free fatty acids, phosophatides, or mucilaginous material, or other gross impurities in the organic liquid. The term "bleaching" is reserved for treatment designed solely to reduce the color of organic liquid. The term "deodorizing" is used for the treatment which has as its primary object to remove the traces of constituents which give rise to flavors and odors from the organic liquid.

The refining of an organic liquid usually employs aqueous reagents in the nature of alkali or acid to remove certain impurities, such as free fatty acids and certain color bodies. Also, the refining treatment can improve the color and odor characteristics of the organic liquid. For example, vegetable oils, especially those subjected to oxidization, suffer from increased red and yellow color components; however, the green color from chlorphyl is not affected. In the hydrogenation of the refined organic liquid, the organic liquid is admixed with a small amount of a hydrogenation catalyst in a finely dispersed state. For example, an amount of metal hydrogenation catalyst less than about 0.05% by weight is introduced into the organic liquid. Then, this mixture is subjected to superatmospheric hydrogen at elevated temperatures for a selected period of time until the desired reaction of the unsaturated and hydrogen reducible materials is reached in the organic liquid. After hydrogenation is completed, the organic liquid carrying the dispersed hydrogenation catalyst is passed through precoated leaf filters for the removal of the metal hydrogenation catalyst. AS is apparent, the nature of filtration will result in a small amount of the metal hydrogenation catalyst being carried with the filtered organic liquid. In many instances, the residual amounts of metal hydrogenation catalysts must be removed by subsequent steps, whic are usually termed "post bleaching", which the residual taces of the metal hydrogenation catalyst are removed through the use of metal scavengers or compounds capable of forming inactive complexes with the metal component. These materials include certain acids such as phosphoric acid and organic acids such as citric and tartaric acids. Naturally, the post bleaching treatment of the hydrogenated organic liquid requires additional filtration with the selected addition of materials such as Filteraid to promote the substantial complete removal of the residual amounts of metal hydrogenation catalyst.

Although hydrogenation of organic liquid improves color relating to yellow and red components, it unfortunately does not remove the pronounced green color from vegetable oil, especially soybean oil. This green color is hydrogenated vegetable oil is most unacceptable in products to be used for human consumption, i.e., edible oils. At the present time, color improvement in an organic liquid is obtained by the use of selected additions of very finely dispersed solid adsorbent into a filtered hydrogenated organic liquid under conditions whereby the color bodies are adsorbed by the solid adsorbent. The organic liquid containing the solid adsobent must again be filtered after the addition of Filteraid material, so that the solid adsorbent is removed. Naturally, each filtering step involves the loss of product even with careful operation under the state of present day mechanical filtration technology.

Color improvement in organic liquid comes within the definition of bleaching treatment. Many types of materials are employed for this purpose. For example, bleaching earth, activated carbon, acid-activated earth and spent hydrogenation catalyst can be employed. However, the problem in conducting the bleaching treatment, as in refining, also involves mechanical filtration procedures to remove the dispersed solids from the purified organic liquid. The same filtration problems additionally exist in the deodorization treatment where a solid dispersed material is employed. Any introduction into the organic liquid of a solid material in a finely dispersed state requires presently a subsequent mechanical filtration step which must be conducted very carefully so that the ultimate degree of removal is obtained without unduly high product losses.

The present invention is a process which employs a combination of steps familiar in everyday practices in the refining and decoloring of organic liquids. However, there are added certain novel steps whereby the resultant combination of steps produces the desired refining and decoloring and/or deodorizing treatments without mechanical filtration of the organic liquid. Furthermore, substantially complete removal of even small amounts of finely divided solid mateials is obtained by uncomplicated procedures and equipment. In addition, the problems involved with oxidization of the organic liquid during mechanical filtration are avoided to insure optimum color and odor characteristics in the organic liquid.

SUMMARY OF THE INVENTION

In accordance with this invention, there is provided a process for quality improvement of non-petroleum organic liquid from the group comprising fats, vegetable and animal oils. The process has the steps of (1) refining the organic liquid with an aqueous reagent, (2) hydrogenating this purified organic liquid in the presence of finely divided catalyst and at elevated temperatures to form a hydrogenated organic liquid, (3) mixing the refined organic liquid of step (1) or the hydrogenated organic liquid of step (2) with a finely divided (dispersed) solid adapted to remove color bodies, and (4) then subjecting the mixture to electrofiltration for substantially complete removal of the hydrogenation catalyst and solid adsorbent from the hydrogenated organic liquid, thereby providing a solids-free and quality improved organic liquid for subsequent utilization. The steps (3) and (4) of mixing and electrofiltration are practised in an atomsphere substantially devoid of oxygen-containing gases.

DESCRIPTION OF THE DRAWING

The drawing is a diagrammatic illustration, in flow schematic, of an arrangement of apparatus for carrying out the novel steps of the present process.

DESCRIPTION OF SPECIFIC EMBODIMENTS

The present process will be described in the purification of one type of organic liquid, namely soybean oil. However, it wll be appreciated that this process is equally applicable and of utility with other types of organic liquid, e.g., fats, and animal and vegetable oils. With reference to the drawing, there is shown an arrangement of apparatus for practicing the steps involved in the present process. However, other arrangements of apparatus which are capable of carrying out the listed steps, by direct or equivalent means, can be employed with equal effect for refining, decoloring and/or deodorizing treatments. More particularly, the steps for refining are conducted in a refining vessel or separator 11, a hydrogenation converter 12, a mixer 13, and an electrofilter 14.

The separator 11 receives a charge of organic liquid such as raw soybean oil through an inlet 16 to which is added a suitable aqueous reagent through a second inlet 17 immediately prior to its entry into the separator. For example, the aqueous reagent may be alkali or an acid. Usually, the aqueous reagent is a relatively weak alkali such as caustic of 5% by weight concentration. However, in certain instances, mineral acids such as sulphuric acid can be employed. The aqueous reagent converts certain impurities in the ray soybean oil into a form where they are separated from the refined soybean oil by settling or other physical separations conducted in the separator 11.

The aqueous phase carrying the separated impurities is removed in an underflow outlet 18 from the separator. The aqueous phase is sent to a suitable disposal facility wherein the removed impurities, such as alkali metal salts, are recovered or suitably disposed. The refined soybean oil from the separator 11 passes through an outlet 19, a pump 21, check valve 22 and inlet 23 into the converter 12. The check valve 22 insures that all subsequent processing is undertaken at superatmospheric pressure conditions.

In addition to refined soybean oil, the converter 12 also receives through the inlet 23 a charge of hydrogenation catalyst introduced at metered amounts through a valve 24. The hydrogenation catalyst can be of any suitable form such as a metal hydrogenation catalyst. For example, the metal hydrogenation catalyst may be nickel metal carried upon a supporting substrate formed of kieselguhr. Only small amounts of hydrogenation catalyst are employed; however, the catalyst is present in a very finely divided state to improve the efficiency of hydrogenation of the refined soybean oil. In addition, the converter 12 receives hydrogen gas at superatmospheric pressure through an inlet 26 which also includes a check valve 27 to insure hydrogenation reaction at superatmospheric pressure. The converter 12 may include heating coils and mixers (not shown) to facilitate reaching the desired hydrogenation level in the soybean oil.

After the hydrogenation of the soybean oil is completed, excess hydrogen gas is vented through an outlet 28 and a control valve 29 until the superatmospheric pressure in the converter drops to some suitable level, for example, 10 psi. The superatmospheric pressure of the residual hydrogen in the converter 12 is not critical, but it should be sufficient that all downstream processing steps are conducted in a hydrogen atmosphere sufficient to completely exclude the entry of any oxygen-containing gases. If desired, an inert gas other than hydrogen, can be employed in the subsequent steps to exclude the entry of oxygen-containing gases. In normal practices, the finely divided catalyst would be removed from the hydrogenated soybean oil by mechanical filtration. However, the mechanical filtration is avoided by the following step of the present process.

The hydrogenated soybean oil and entrained finely divided hydrogenation catalyst is removed from the converter 12 through the outlet 31 and a control valve 32 for introduction into the mixer 13. The mixer 13 can receive all or part of the admixture of soybean oil and hydrogenation catalyst from the converter 12. Alternatively, a regulated flow of the admixture can be sent through the mixer 13. The mixer 13 also receives a proper charge of solid adsorbent (e.g., 0.1% wt.) introduced through an inlet 33 and control valve 34. More particularly, in either batch or continuus operations, a sufficient amount of the solid adsorbent is added to the hydrogenated soybean oil that the color bodies are removed effectively by adsorption.

Assume that the solid adsorbent is introduced at a proper rate by adjusting the valve 34 relative to the flow of hdyrogenated soybean oil carrying entrained finely divided hydrogenation catalyst regulated by the valve 32. The mixer 13 is operated to provide a finely divided dispersion of solid adsorbent at relative constant concentration with the soybean oil and entrained catalyst. For this purpose, the mixer 13 includes a shaft carrying a plurality of mixing paddles 36 rotated by prime mover 37 comprising an electric motor carrying an integral gear box. The resultant admixture is passed directly from the mixer 13 through an outlet 38 into the electrofilter 14.

The solid adsorbent can be selected from the group of materials employed in the conventional decoloring of organic liquid. Examples of the solid adsorbents include spent hydrogenation catalyst, bleaching earth, fuller's earth, diatomaceous earth, activated carbon, and kieselguhr. Of a special utility in removing from soybean oil the green color resulting from chlorphyll is the acid activated earth materials. Certain of the solid adsorbents are obviously of greater utility than others depending upon the particular type of organic liquid and its prior treatments encountered in the edible oil industry.

The hydrogenation reaction in the converter 12 usually reduces the red and yellow color producing constituents in soybean oil. As a result, the green color from chlorophyll becomes greatly pronounced. Thus, the solid adsorbent is selected to remove chlorophyll which has a color band in 6400 and 6600 angstroms. Other color bodies require some variation in type and amounts of the solid adsorbent for the complete removal of these mateials. An effective amount of the solid adsorbent should be used. Generally, more than about 0.01% by weight of the solid adsorbent must be introduced in admixture into the hydrogenated soybean oil carrying the finely divided hydrogenation catalyst.

In many cases, the admixture flows from the mixer 13 through to the outlet 38 as a result of the residual superatmospheric hydrogen pressure. However, a pump 39 can be used to move the admixture from the mixer 13 through a check valve 41 into the electrofilter 14 for process control or for other reasons.

The electrofilter 14 receives the hydrogenated soybean oil, entrained catalyst and the solid adsorbent under superatmospheric pressure and in an atmosphere substantially devoid of oxygen-containing gases. Exclusion of oxygen-containing gases from the mixer 13 and the electrofilter 14 produces a superior decoloring of the organic liquid, and specifically in the present example, the soybean oil.

The electrofilter 14 is a pressure vessel 15 containing a porous particulate bed disposed in an intense electrical field so that solids in the organic liquid are removed by their induced adherence to the particulate bed. The electrofilter 14 is formed of a metal vessel 15 with an inlet 42 and outlet 56 and contains a suitable particulate solid material 44 completely filling its interior. The electrofilter 14 receives preferably a continuous and uniform flow of the admixture flowing through an inlet 42 into a distributor 43 provided by pipe cross arms containing metering openings. The interior of the vessel contains a plurality of energized electrodes 46 in spaced relationship to a plurality of grounded electrodes 47. Preferably, the electrodes 46 and 47 are vertically elongated metal tubes and have substantial overlapping dimensions defining an electric field within the particulate material 44 contained in the electrofilter 14. The electrodes 46 are suspended from the vessel 15 by insulators 48. In addition, the electrodes 46 are energized by an external power supply 49 providing a high intensity potential through a conductor 51, an entrance bushing 52 and a flexible lead 53 to the electrodes 46. The power supply 49 can be grounded to the vessel 15 by conductor 54.

The electrofilter 14 applies the high intensity electric field to induce the tenaceous adhesion of the hydrogenation catalyst and solid adsorbent upon the particulate material 44. It is preferred that the power supply 49 provides a high intensity d.c. electric field within the particulate material 44 contained within the electric field defined by the electrodes 46 and 47. Preferably, the electic field produces a potential gradient in the particulate material 44 of about not less than 20 kilovolts per inch. A certain type of particulate material 44 should be employed for optimum results. The material 44 are rigid solid particles having a relatively low dielectric constant (below about 6). More particularly, the particulate material should be chemically inert, incompressible, hard granular and rigid in nature with a non-spheroidal configuration. The particulate material can be a solid mineral containing crystalline silicon dioxide such as flint, garnet, granite and fused quartz. Preferably, the mineral is crushed to provide non-spheroidal configurations which have relatively discontinuous surfaces. For example, crushed flint rock hving particle sizes of its minimum dimensions between ⅛ and ½ inch are employed to good advantage in the present process.

The electrofilter 14 produces the substantially complete removal of the hydrogenation catalysts and the solid adsorbent as the organic liquid passes from the inlet 42 through the bed material 44 to the outlet 56. As a result, the soybean oil removed through the outlet 56 is simultaneously solids-free and color improved. A second mechanical filtration step of conventional refining is avoided. The product soybean oil flows through a backpressure valve 57 which is set to maintain the desired superatmospheric pressure previously mentioned in the converter, mixer and electrofilter. The produce soybean oil is carried through a conduit 58 to a subsequent utilization, as for example, consumer product.

In a pilot plant test, a small amount (about 0.1% by weight) of a commercial bleaching clay (Filtrol grade 105) was added to hydrogenated soybean oil in a mixer, thereby forming a mixture of hydrogenated soybean oil, nickel hydrogenation catalyst and the bleaching clay. This mixture was passed through a small electrofilter having crushed flint rock (Flintbrasive No. 11) in an electrical field having a gradient of about 20 kv/in., d.c. Complete removal of all entrained solids was obtained with the quality improved hydrogenated soybean oil having a "green density" (spectrophotometer) color of 83. Electrofiltration of the hydrogenated soybean oil (without bleaching clay) produced a color of 160. The commercial acceptable standard color is 100, so that the present process produces a color improvement vastly superior to conventional practices.

In another embodiment of this process, the solid adsorbent can be added directly to the refined organic liquid introduced through the inlet 23 into the converter 12 prior to, during, or after the hydrogenation reaction. For this purpose, a source of the solid adsorbent is passed through a pump 61 and checkvalve 62 into the inlet 23 of the converter 12. The solid adsorbent can be carried in a small amount of hydrogenated organic liquid to improve pumpability, if desired. The hydrogenation reaction in the converter 12 insures complete admixture. Introduction of the solid adsorbent directly into the converter 12 makes optional the use of the mixer 13. However, the results produced by either embodiment of the present process are the same.

It will be apparent from the foregoing steps that at least two expensive and difficult-to-conduct mechanical filtration steps have been avoided. The first mechanical step which is avoided is that conventionally following the converter 12. The second mechanical filtration step which is avoided is that conventionally following the introduction of solid adsorbent in the mixer 13. In addition to these advantages, the product soybean oil from the electrofilter 14 is exceptional in color and very clean in that, for practical purposes, no residual solids (including nickel) of hydrogenation catalyst and solid adsorbent are present in any significant amounts. No subsequent conventional treatment for removing nickel metal contaminants, such as by treatment with phosphoric acid or organic acids such as citric or tartaric is required! In many cases, the solid adsorbent introduced into the mixer 13 can also provide substantial deodorization of the hydrogenated soybean oil as an added advantage.

In addition to the above listed advantages, it will be apparent that there has been provided a process well adapted for improving the color, odor and reducing solids or organic liquids. The present process is completely compatible with present day operations in the food industry, or other places, where organic liquids are purified. It is to be understood that certain features and alterations of the present process may be employed without departing from the spirit of this invention. This is contemplated by, and is within, the scope of the appended claims. It is intended that the presently described embodiments are to be taken as illustrative of the claimed process.

What is claims is:

1. A process for the hydrogenation and purification of a substance selected from the group consisting of fats, animal oils and vegetable oils comprising:

a. refining said substance to remove gross impurities;

b. forming a mixture of the refined product of step (a), a finely divided hydrogenation catalyst and a finely dispersed solid adsorbent adapted to remove color bodied in an atmosphere substantially devoid of oxygen-containing gases;

c. hydrogenating the refined product of step (a) with hydrogen in the presence of said hydrogenation catalyst and said solid adsorbent, and at elevated temperatures, thereby producing a hydrogenated product carrying the entrained hydrogenation catalyst and the solid adsobent; and d. in an atmosphere substantially devoid of oxygen-containing gases, subjecting the product of step (c) to electrofiltration for the substantially complete removal of the hydrogenation catalyst and solid adsobent from said hydrogenated product, thereby providing a solids-free, color improved hydrogenated product.

2. The process of claim 1, wherein said substance is an edible vegetable oil and said solid adsorbent is added in an amount sufficient to effectively remove the color bodies.

3. The process of claim 2 wherein said solid adsorbent is selected from the group consisting of spent hydrogenation catalyst, bleaching earth, fuller's earth, diatomaceous earth, activated carbon and kieselguhr.

4. The process of claim 2 wherein said solid adsorbent is spent nickel hydrogenation catalyst.

5. The process of claim 2 wherein said solid adsorbent is bleaching earth.

6. The process of claim 2 wherein said solid adsorbent is acid-activated earth.

7. The process of claim 2 wherein said edible vegetable oil is refined in step (a) with an aqueous alkali reagent.

8. The process of claim 2 wherein said edible vegetable oil is refined in step (a) with an aqueous acid.

9. The process of claim 2 wherein said substance is soybean oil having a green coloration attributed to its chlorophyll content, refining step (a) comprises treating said soybean oil with an aqueous alkali reagent and the solid adsorbent is acid-activated earth in an amount sufficient to effectively remove said green coloration.

10. The product of the process of claim 9.

11. A process for the hydrogenation and purification of a substance selected from the group consisting of fats, animal oils and vegetable oils comprising:

a. refining said substance to remove gross impurities;

b. hydrogenating the refined product of step (a) with hydrogen in the presence of a finely divided hydrogenation catalyst dispersed therein and at elevated temperatures, thereby forming a hydrogenated product carrying entrained hydrogenation catalyst;

c. forming a mixture of said hydrogenated product carrying entrained hydrogenation catalyst and a finely dispersed solid adsorbent adapted to remove color bodies in an atmosphere substantially devoid of oxygen-containing gases; and d. in an atmosphere subtantially devoid of oxygen-containing gases subjecting the mixture obtained in step (c) to electrofiltration for the substantially complete removal of the hydrogenation catalyst and solid adsorbent from the hydrogenated organic liquid thereby providing a solids-free, color improved hydrogenated product.

12. The process of claim 11 wherein said substance is an edible vegetable oil and said solid adsorbent is added in an amount sufficient to effectively remove the color bodies.

13. The process of claim 12 wherein said solid adsorbent is selected from the group consisting of spent hydrogenation catalyst, bleaching earth, fuller's earth, diatomaceous earth, activated carbon and kieselguhr.

14. The process of claim 12 wherein said solid adsorbent is spent nickel hydrogenation catalyst.

15. The process of claim 12 wherein said solid adsorbent is bleaching earth.

16. The process of claim 12 wherein said solid adsorbent is acid-activated earth.

17. The process of claim 12 wherein said edible vegetable oil is refined in step (a) with an aqueous alkali reagent.

18. The process of claim 12 wherein said edible vegetable oil is refined in step (a) with an aqueous acid.

19. The process of claim 12 wherein said substance is soybean oil having a green coloration attributed to is chlorophyll content, refining step (a) comprises treating said soybean oil with an aqueous alkali reagent and the solid adsorbent is acid-activated earth in an amount sufficient to effectively remove said green coloration.

20. The product of the process of claim 19.

21. A process for the purification of a hydrogenated refined substance selected from the group consisting of fats, animal oils and vegetable oils, said hydrogenated refined substance containing color bodies and carrying entrained hydrogenation catalyst, which comprises subjecting said hydrogenated refined substance in admixture with a finely dispersed solid adsorbent adapted to remove color bodies, in an atmosphere substantially devoid of oxygen-containing gases, to electrofiltration for the substantially complete removal of the hydrogenation catalyst and solid adsorbent from the hydrogenated product, thereby providing a solids-free quality improved hydrogenated product.

22. The process of claim 21, wherein said substance is an edible vegetable oil and said solid adsorbent is present in an amount sufficient to effectively remove the color bodies.

23. The process of claim 22 wherein the electrofiltration in step (d) is provided by a bed of dieletric particulate solids interposed within an electrical fluid having a sufficient intensity that the hydrogenation catalyst and solid adsorbent adhere to the particulate solids in the bed traversed by the hydrogenated product.

24. The process of claim 23 wherein the bed has particulate solids of a chemically inert, incompressible, hard granular and rigid nature with a non-spheroidal configuration.

25. The process of claim 24 wherein the particulate solids are a mineral containing crystalline silicon dioxide.

26. The process of claim 25 wherein the particulate solids are selected from the group consisting of flint, garnet, granite and fused quartz.

27. The product of the process of claim 22.

* * * * *